United States Patent [19]

Wolff

[11] Patent Number: 4,548,701

[45] Date of Patent: Oct. 22, 1985

[54] METHOD FOR EXTRACTION SOLVENT RECOVERY

[75] Inventor: William F. Wolff, Park Forest, Ill.

[73] Assignee: Amoco Corporation, Chicago, Ill.

[21] Appl. No.: 563,113

[22] Filed: Dec. 19, 1983

[51] Int. Cl.[4] ..... C10G 1/04

[52] U.S. Cl. ..... 208/11 LE; 203/6; 203/33; 203/43; 208/8 LE; 208/45; 570/117; 570/121; 570/178; 585/240

[58] Field of Search ..... 208/11 LE, 8 LE; 203/33, 6, 43, 36, 37; 570/117, 121, 178; 585/240

[56] References Cited

U.S. PATENT DOCUMENTS

| | | | |
|---|---|---|---|
| 2,280,794 | 4/1942 | Cass | 203/36 |
| 2,589,212 | 3/1952 | Agapelus et al. | 203/37 |
| 2,653,904 | 9/1953 | Hanna et al. | 203/36 |
| 3,846,253 | 11/1974 | Obrecht | 203/6 |
| 4,046,669 | 9/1977 | Blaine et al. | 208/11 LE |
| 4,055,480 | 10/1977 | Smith et al. | 208/11 LE |
| 4,057,485 | 11/1977 | Blaine et al. | 208/11 LE |

*Primary Examiner*—D. E. Gantz
*Assistant Examiner*—A. Pal
*Attorney, Agent, or Firm*—William E. Murray; William McClain; William H. Magidson

[57] ABSTRACT

A method for recovery of extraction solvent from a dissolved solute wherein halogen gas evolution and halogen compound retention in the solute are minimized comprises heating a solution of a halogenated organic solvent and the extracted solute in the presence of an ammonium, Group I metal or Group II metal salt of an acid of carbon number 1 to 6, such as ammonium bicarbonate, ammonium carbonate, ammonium formate, sodium carbonate, sodium formate, or calcium formate, to recover the solvent and the solute.

32 Claims, No Drawings

METHOD FOR EXTRACTION SOLVENT RECOVERY

The invention relates generally to solvent recovery of extraction solvents from a solute and more particularly to a method for stripping a halogenated organic solvent from a solute in the presence of an ammonium, Group I metal or Group II metal salt of an acid having a carbon number of 1 through 6.

Halogenated organic solvents are often used as extraction solvents for extracting solute from a solute-containing material or liquid. For example, methylene chloride has been used to extract bitumen from bitumen-containing tar sands. These expensive halogenated solvents must be recovered to minimize process costs, and separation of the solvent from the solute for solvent recovery typically requires distillation of the halogenated solvent. A major problem in recovery of halogenated solvents is they decompose on heating, resulting in evolution of a halogen gas, such as hydrogen chloride, which is corrosive and highly toxic. In addition, the solute retains the halogen decomposition products which can be deleterious to the solute's use. This decomposition problem is increased because the solvent must be heated above its boiling point for complete recovery.

Additives such as urea, tribenzylamine, or orthotolidine have been added to the solution during the halogenated solvent evaporation to prevent decomposition of the halogenated solvent. These additives have not proved entirely successful in preventing halogen gas evolution and halogen retention.

The general object of this invention is to prevent the decomposition of halogenated organic solvents during distillation of the solvent from the solute. A further object is to use low cost, safe, non-caustic additives to prevent solvent decomposition. Another object is to evaporate halogenated solvent from a solution of the solvent and bitumen extracted from a carbonaceous material. Other objects appear below.

SUMMARY OF THE INVENTION

The invention comprises a method for solvent recovery of extraction solvent from a solute which comprises stripping a halogenated organic solvent from the solute in the presence of an ammonium, Group I metal, or Group II metal salt of an acid having a carbon number of 1 through 6. This invention has the advantage of evaporating and recovering the halogenated organic solvent while concommitantly minimizing its decomposition, thereby preventing evolution of corrosive and toxic halogen gases and retention of halogen compounds in the recovered solute.

Further, the invention has the advantage that it facilitates recovering a bitumen solute of low halogen content by extracting bitumen from a bitumen containing material with a halogenated organic solvent; and stripping the solvent at elevated temperatures from the extracted bitumen preferably in the presence of about 0.5 to about 5.0 weight percent based on the bitumen of an ammonium salt of an acid or carbon number 1 or 2, such as ammonium bicarbonate, ammonium carbonate, and ammonium formate.

DETAILED DESCRIPTION OF THE INVENTION

The invention is directed to separation and recovery of halogenated organic solvents from a solute. The most stable halogenated solvents decompose to some extent on distillation, thus evolving halogen gases and retaining halogen compounds in the recovered solute. The evolved halogen gases are toxic and corrosive, and halogen retention in the solute adversely affects solute properties. The decomposition problem is particularly acute in the extraction of bitumen from a bitumen containing carbonaceous material, such as tar sands, because the solvent strongly adheres to the bitumen and requires heating above the solvent boiling point for essentially complete removal.

The invention comprises a method for the evaporation of a halogenated organic solvent from a solution of extracted solute and the halogenated solvent in the presence of an ammonium, Group I metal, or Group II metal salt of an acid having a carbon number of 1 through 6, wherein decomposition of the halogenated solvent is minimized. The presence of the salt lessens solvent decomposition to extensively reduce halogen compound retention in the solute and halogen gas evolution. In comparison, as the examples below demonstrate, conventional additives in fact increase halogen retention in a solute.

The mechanism by which these salts minimize halogenated solvent decomposition is not fully understood. However, without wishing to be bound by theory, Applicant believes the salt decreases the formation of halogen containing free radicals.

In a preferred aspect, the invention comprises an improved method for the recovery of bitumen having a low halogen content from a bitumen containing material, which can be any bitumen containing material such as oil shale, tar sands, heavy oils and petroleum resids, and coal, oil shale or biomass which has first been treated, by heating for example, to form bitumen. As used herein, the term bitumen means a mixture of a variety of hydrocarbons, which can include heterocyclic compounds. For example, bitumen-containing tar sands are contacted with a halogenated organic solvent and a solvent solution of bitumen is separated from spent sand in a hydrocyclone or other separating device. The halogenated solvent is evaporated from the bitumen in the presence of an ammonium, Group I metal or Group II metal salt of an acid having a carbon number of 1 or 2 to prevent the decomposition of the halogenated solvent, thereby recovering bitumen low in halogen content and recovering the solvent. Bitumen with a low halogen content is highly desirable because high halogen content can cause corrosion problems during refinery treating of the bitumen. Here the salt is preferably ammonium bicarbonate, ammonium carbonate, or ammonium formate in an amount of about 0.5 to about 5.0 weight percent based on the amount of bitumen.

The decomposition preventing salts can also be used in treating halogenated solvents to remove dissolved impurities. For example, halogenated solvents can be distilled in the presence of the salt for purification.

The halogenated organic solvents useful in the invention are hydrocarbons of carbon number 1 through 6 substituted by at least one halogen atom and have extensive use as extraction solvents due to their high solubility power. Although higher molecular weight solvents can be used, solvents of carbon number 1 to 6 preferred because of their lower cost and their higher volatility which permits evaporation under less severe conditions. Typical solvents are chloroform, methylene chloride, and perhalo compounds such as carbon tetrachloride, Freon-12 ($CF_2Cl_2$), Freon-11 ($CFCl_3$) and Freon-114 ($C_2F_4Cl_2$). The halogenated solvent used in the recovery of bitumen of low halogen content preferably has a boiling point less than about 50° C. and a carbon number of 1 through 3, since these solvents are good solvents for bitumen, are relatively inexpensive, and can be recovered at relatively lower temperature.

Useful salts include ammonium, Group I metal, or Group II metal salts of an acid having a carbon number of 1 to 6, although larger acids can be used. Acids of carbon number 1 to 6 are preferred because their salts are inexpensive with high volatility or solubility. More preferred are salts of the above cations with acids of carbon number 1 or 2 because of still higher volatility and are, for example, ammonium formate, ammonium carbonate, ammonium bicarbonate, ammonium oxalate, calcium formate, and sodium formate. Ammonium salts of acids of carbon number 1 or 2, such as ammonium bicarbonate, ammonium carbonate, and ammonium formate, are most preferred because they are most effective in minimizing both halogen gas evolution and halogen compound retention in the solute, with ammonium bicarbonate the most preferred because of low cost.

The amount of salt is within the range of about 0.5 to about 50 weight percent based on the amount of the solute in the halogenated solvent, and preferably within about 0.5 to about 20 weight percent to avoid problems of salt solubility in the solvent. More preferably, about 0.5 to about 5 weight percent is used because there is a relatively small advantage in higher concentration to compensate for increased salt cost.

The process steps of the invention are discussed in somewhat greater detail with reference to recovery of bitumen from bitumen containing tar sands. Initially the halogenated solvent, for example, Freon-114, contacts tar sands for a time sufficient to extract bitumen and spent tar sand is separated from the bitumen solvent solution. The manner of solvent and tar sand contacting and spent sand separation is conventional and known to those skilled in the art.

The halogenated solvent is stripped from the bitumen solute to recover the bitumen and solvent. A portion or the bulk of the solvent can be removed under pressures and temperatures for a time period which do not decompose the solvent, but at some point more severe conditions of longer time and heating are necessary to remove all of the solvent from the bitumen. At this point, solvent stripping results in evolution of halogen gas and halogen compound retention. The salt is added to the bitumen solvent solution either before or after removal of a portion of the solvent, but must be present before the bitumen is evaporated to a substantially solvent free state.

The bitumen, solvent and salt are then heated to a temperature above about 100° C., preferably about 130° to about 170° C. and more preferably less than about 200° C., although higher temperatures can be used, for a sufficient time to obtain satisfactory and relatively fast solvent removal. The heating is under conditions where the solution is well agitated or spread in a thin film, for example, in a thin film evaporating apparatus. The pressures during the solvent stripping are atmospheric or subatmospheric depending on the solvent boiling point, with subatmospheric pressures used to speed up the stripping. After stripping of substantially all solvent from the bitumen, the bitumen is recovered and the recovered solvent can be reused.

The following examples illustrate the invention in the recovery of bitumen extracted from tar sand with a halogenated solvent.

EXAMPLES 1–20

In the experimental procedure used in Examples 1–20, about 27 cc of a solution of halogenated organic solvent and bitumen extracted from tar sand from Sunnyside, Utah, was charged to a 100 milliliter flask together with a specified amount of the salt or conventional additive. The solution contained about 12 weight percent bitumen containing about 0.6 weight percent inorganic solids. Most of the solvent was removed by heating the mixture gently while passing nitrogen through the flask. The flask was then fitted so that the purge nitrogen bubbled into an aqueous solution of $HNO_3$ acidified silver nitrate where any evolved HCl in the nitrogen precipitated. The bitumen, solvent, and salt solution was heated to a specified temperature, held at that temperature for a specified time, and then cooled. Blank runs with the solvents used without the salt or conventional additive were made as above with the flasks heated to a final temperature of 170° C. for one hour.

To determine the relative amounts of retained halogen compounds, the flask contents after solvent stripping were weighed, dissolved in about 9.0 grams tetralin, the tetralin solution was centrifuged, and the decanted liquids were analyzed for chlorine. The concentrations of chlorine per unit weight of bitumen were calculated and compared to the blank runs to give the relative amount of chlorine retained in the bitumen. To measure relative amounts of halogen gas, HCl, evolved, the silver chloride precipitates were filtered, dried and weighed. The weights of silver chloride per unit weight of bitumen were calculated and compared to the blank runs to give the relative amounts of HCl evolved.

Table I illustrates the conditions in Examples 1–20 including the solvent, the salt, weight percent of the salt based on the weight of bitumen, and the time and the temperature of heating. Table II shows the HCl evolution and chlorine retention on a relative percent basis compared to the blank run made with the same solvent.

TABLE I

| Run | Solvent | Additive | Wt. % Additive Based on Bitumen | Heat-Treat. Time Hr. | Heat-Treat. Temp. °C. |
|---|---|---|---|---|---|
| 1 | Freon-11 | Ammonium Formate | 2.1 | 1.0 | 170 |
| 2 | Freon-11 | Ammonium Formate | 3.5 | 1.0 | 170 |
| 3 | Freon-11 | Ammonium Formate | 11 | 1.0 | 170 |
| 4 | Freon-11 | Ammonium Carbonate | 21 | 1.0 | 170 |
| 5 | Freon-11 | Ammonium Bicarbonate | 3.5 | 1.0 | 170 |
| 6 | Freon-11 | Ammonium Bicarbonate | 22 | 1.0 | 170 |
| 7 | Freon-11 | Ammonium Formate | 18 | 1.1 | 150 |
| 8 | Freon-11 | Calcium Formate | 18 | 1.0 | 170 |
| 9 | Freon-11 | Sodium Formate | 17 | 1.0 | 170 |
| 10 | Freon-11 | Sodium Carbonate | 3.9 | 1.1 | 175 |
| 11 | Freon-11 | Sodium Carbonate | 15 | 1.1 | 175 |
| 12 | Freon-11 | Urea | 2.2 | 1.0 | 170 |
| 13 | Freon-11 | Urea | 12 | 1.0 | 175 |
| 14 | Freon-11 | Tribenzylamine | 12 | 1.0 | 170 |
| 15 | Freon-11 | o-Tolidine | 12 | 1.0 | 170 |

TABLE I-continued

| Run | Solvent | Additive | Wt. % Additive Based on Bitumen | Heat-Treat. Time Hr. | Heat-Treat. Temp. °C. |
|---|---|---|---|---|---|
| 16 | $CH_2Cl_2$ | Ammonium Formate | 3.9 | 1.0 | 170 |
| 17 | $CH_2Cl_2$ | Ammonium Formate | 21 | 1.0 | 170 |
| 18 | $CH_2Cl_2$ | Ammonium Bicarbonate | 4.1 | 1.0 | 170 |
| 19 | $CH_2Cl_2$ | Ammonium Bicarbonate | 25 | 1.0 | 170 |
| 20 | $CH_2Cl_2$ | Ammonium Formate | 20 | 4.0 | 130 |

TABLE II

| Run | % Relative to Blank Run w/o Additive: HCl Evolution | % Relative to Blank Run w/o Additive: Chlorine Retention |
|---|---|---|
| 1 | 5 | 66 |
| 2 | 8 | 42 |
| 3 | 5 | 38 |
| 4 | — | 26 |
| 5 | 13 | 24 |
| 6 | 16 | 27 |
| 7 | 36 | 71 |
| 8 | 17 | 71 |
| 9 | 18 | 87 |
| 10 | 33 | 127 |
| 11 | 8 | 129 |
| 12 | 5 | 209 |
| 13 | 5 | 120 |
| 14 | 3 | 140 |
| 15 | 3 | 217 |
| 16 | — | 60 |
| 17 | — | 61 |
| 18 | — | 66 |
| 19 | — | 76 |
| 20 | — | 16 |

Runs 1 through 15 were made with Freon-11 as the solvent and runs 1 through 7 demonstrate the effectiveness of the most preferred salts in limiting chlorine retention and HCl evolution in stripping the solvent at temperatures from about 150° C. to about 170° C. Runs 8 and 9 show that sodium and calcium formate are also effective in preventing HCl evolution and chlorine retention but not as effective as the preferred ammonium salts. Runs 10 and 11 show that sodium carbonate reduces halogen evolution and, although it does not reduce chlorine retention compared to the blank, does reduce retention compared to the conventional additives. Runs 12 through 15 demonstrate the conventional additives, urea, tribenzylamine, and ortho-tolidine, failed to retard and instead caused more chlorine retention.

Runs 16 through 20 demonstrate the effectiveness of the invention in limiting chlorine retention and HCl evolution in recovery of methylene chloride at temperatures of 130° C. to 170° C. Because of the small amount of HCl evolved in these runs, no meaningful values for the HCl evolution comparison were obtained.

The examples illustrate the utility of the invention in stripping and recovering halogenated solvents from a solute, such as bitumen or a heavy oil, to give products low in undesirable retained halogen compounds while minimizing the emission of corrosive hydrogen halides. In addition, the additives used have the advantage of being cheap, safe, and non-caustic chemicals that can be generated or regenerated in-situ.

Having thus described the invention, it should be understood that the above is merely illustrative and the full scope of the invention is given by the following claims.

I claim:

1. A method for solvent recovery of extraction solvents from a solute comprising: stripping a halogenated organic solvent from solute in the presence of an ammonium, Group I metal, or Group II metal salt of an acid having a carbon number of 1 to 6 to evaporate the solvent and recover the solute and the solvent, wherein decomposition of the solvent and halogenation of the solute are minimized.

2. The method of claim 1 wherein the amount of salt is within about 0.5 to about 50 weight percent based on the amount of solute.

3. The method of claim 1 wherein the salt is selected from the group consisting of ammonium carbonate, ammonium bicarbonate, ammonium formate, ammonium oxalate, sodium formate, and calcium formate.

4. The method of claim 1 wherein the halogenated organic solvent is a hydrocarbon of carbon number 1 through 6 and is substituted by at least one halogen atom.

5. The method of claim 4 wherein the solvent is selected from the group consisting of methylene chloride, chloroform, and perhalo compounds.

6. The method of claim 1 wherein the halogenated solvent has a boiling point less than about 50° C.

7. The method of claim 6 wherein the stripping is performed at a temperature of within about 100° C. to about 200° C.

8. The method of claim 1 wherein the stripping is performed at a temperature within about 100° C. to about 200° C.

9. A method for recovery of halogenated organic solvent from a solute comprising: stripping a halogenated organic solvent from an extracted solute in the presence of an ammonium salt of an acid having a carbon number of 1 or 2 to evaporate the solvent and recover the solute and solvent, wherein decomposition of the solvent and halogenation of the solute are minimized.

10. The method of claim 9 wherein the amount of salt is within about 0.5 to about 50 weight percent based on the amount of solute.

11. The method of claim 9 wherein the amount of salt is within about 0.5 to about 5.0 weight percent based on the amount of solute.

12. The method of claim 9 wherein the halogenated organic solvent is a hydrocarbon of carbon number 1 to 6 substituted by at least one halogen.

13. The method of claim 12 wherein the amount of salt is within about 0.5 to about 5.0 weight percent based on the amount of solute.

14. The method of claim 9 wherein the stripping is performed at a temperature of within about 100° C. to about 200° C.

15. A method for recovery of bitumen from a bitumen containing material comprising: contacting a bitumen containing carbonaceous material with a halogenated organic solvent; separating spent material from the resulting solvent bitumen solution in the presence of an ammonium, Group metal, or Group II metal salt of an acid of carbon number 1 or 2 to evaporate the solvent and recover the bitumen and the solvent, wherein decomposition of the solvent and halogenation of the bitumen are minimized.

16. The method of claim 15 wherein the bitumen containing carbonaceous material is selected from the group consisting of oil shale, tar sands, heavy oils, petroleum resids, and coal, oil shale or biomass which has been treated to produce bitumen.

17. The method of claim 15 wherein the salt is selected from the group consisting of ammonium bicarbonate, ammonium carbonate, and ammonium formate.

18. The method of claim 15 wherein the amount of salt is about 0.5 to about 5.0 weight percent based on the amount of bitumen.

19. The method of claim 15 wherein the halogenated organic solvent has a carbon number of 1 to 6 and is substituted by at least one halogen.

20. The method of claim 19 wherein the halogenated solvent has a boiling point less than about 50° C.

21. The method of claim 20 wherein the bitumen solvent solution is heated to a temperature within about 100° C. to about 200° C.

22. The method of claim 15 wherein the bitumen solvent solution is heated to a temperature within about 100° C. to about 200° C.

23. The method of claim 1 wherein the solute is bitumen.

24. The method of claim 9 wherein the solute is bitumen.

25. A method for the recovery of bitumen from a bitumen containing material comprising:

contacting a bitumen containing carbonaceous material with a halogenated organic solvent;

separating spent material from the resulting solvent bitumen solution; and stripping the solvent bitumen solution in the presence of an ammonium salt of an acid of carbon number 1 or 2 to evaporate the solvent and recover the bitumen and the solvent, wherein decomposition of the solvent and halogenation of the bitumen are minimized.

26. The method of claim 25 wherein the bitumen containing carbonaceous material is selected from the group consisting of oil shale, tar sands, heavy oils, petroleum resids, and coal, oil shale or biomass which has been treated to produce bitumen.

27. The method of claim 25 wherein the salt is selected from the group consisting of ammonium bicarbonate, ammonium carbonate, and ammonium formate.

28. The method of claim 25 wherein the amount of salt is about 0.5 to about 5.0 wt.% based on the amount of bitumen.

29. The method of claim 25 wherein the halogenated organic solvent has a carbon number of 1 to 6 and is substituted by at least one halogen.

30. The method of claim 29 wherein the halogenated solvent has a boiling point less than about 50° C.

31. The method of claim 30 wherein the bitumen solvent solution is heated to a temperature within about 100° C. to about 200° C.

32. The method of claim 25 wherein the bitumen solvent solution is heated to a temperature within about 100° C. to about 200° C.

* * * * *